US008477972B2

(12) United States Patent
Buhmann et al.

(10) Patent No.: US 8,477,972 B2
(45) Date of Patent: Jul. 2, 2013

(54) METHOD FOR OPERATING A HEARING DEVICE

(75) Inventors: Joachim M. Buhmann, Zurich (CH); Sascha Korl, Schonenberg (CH); Yvonne Moh, Zurich (CN); Peter Orbanz, Zurich (CH)

(73) Assignee: Phonak AG, Stafa (CH)

( * ) Notice: Subject to any disclaimer, the term of this patent is extended or adjusted under 35 U.S.C. 154(b) by 182 days.

(21) Appl. No.: 12/934,388

(22) PCT Filed: Mar. 27, 2008

(86) PCT No.: PCT/EP2008/053666

§ 371 (c)(1),
(2), (4) Date: Sep. 24, 2010

(87) PCT Pub. No.: WO2008/084116

PCT Pub. Date: Jul. 17, 2008

(65) Prior Publication Data

US 2011/0058698 A1 Mar. 10, 2011

(51) Int. Cl.
*H04R 25/00* (2006.01)

(52) U.S. Cl.
USPC ..... 381/312; 381/316; 381/318

(58) Field of Classification Search
USPC ..... 381/312, 316–318, 320–321
See application file for complete search history.

(56) References Cited

U.S. PATENT DOCUMENTS

| | | | | |
|---|---|---|---|---|
| 4,852,175 | A * | 7/1989 | Kates | 381/317 |
| 6,240,192 | B1 * | 5/2001 | Brennan et al. | 381/314 |
| 6,768,801 | B1 * | 7/2004 | Wagner et al. | 381/312 |
| 2003/0144838 | A1 | 7/2003 | Allegro | |

FOREIGN PATENT DOCUMENTS

| | | | |
|---|---|---|---|
| EP | 0681411 | A1 | 11/1995 |
| EP | 0814636 | A1 | 12/1997 |
| EP | 1404152 | A2 | 3/2004 |
| EP | 1513371 | A2 | 3/2005 |

(Continued)

OTHER PUBLICATIONS

International Search Report for PCT/EP2008/053666 dated Jan. 27, 2009.

(Continued)

*Primary Examiner* — Suhan Ni
(74) *Attorney, Agent, or Firm* — Pearne & Gordon LLP

(57) ABSTRACT

A method for operating a hearing device comprising an input transducer (1), an output transducer (3) and a signal processing unit (2) for processing an output signal of the input transducer (1) to obtain an input signal for the output transducer (3) by applying a transfer function to the output signal of the input transducer (1) is disclosed. The method comprises the steps of:

Figure 1:
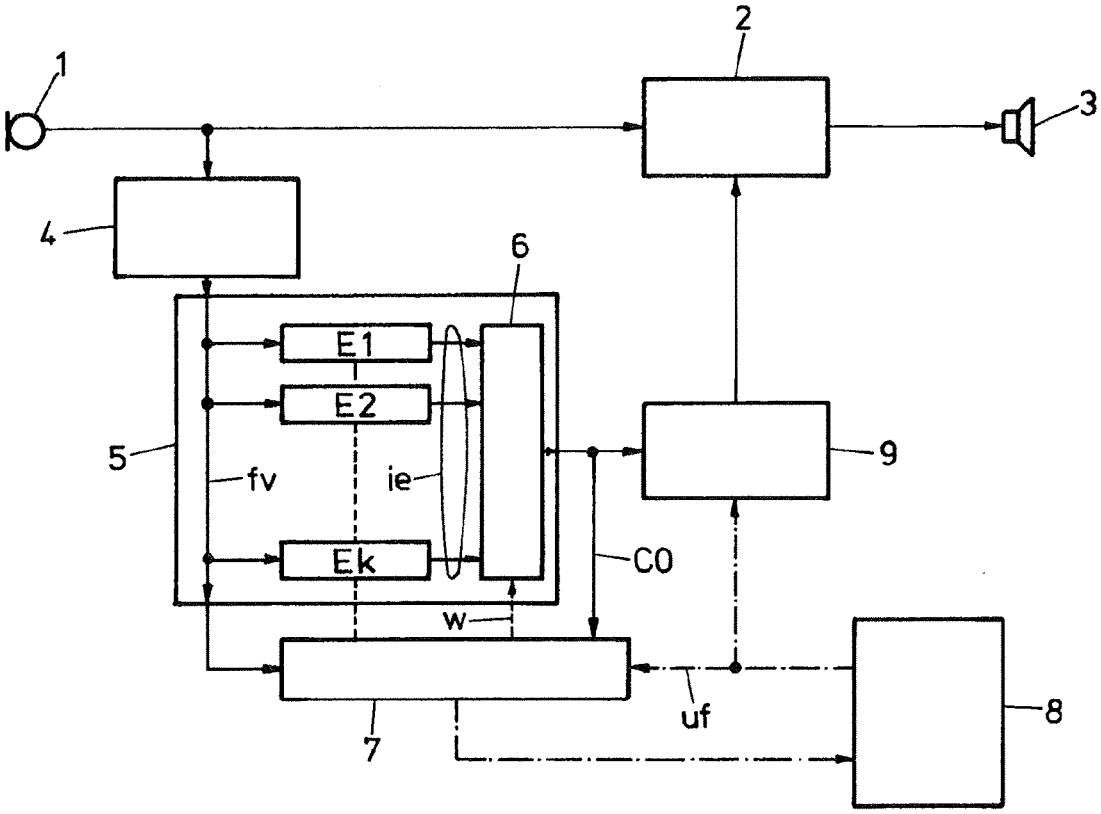

extracting features (fv) of the output signal of the input transducer (1), classifying the extracted features (fv) by at least two classifying experts (E1, . . . , Ek), weighting the outputs of the at least two classifying experts (E1, . . . , Ek) by a weight vector (w) in order to obtain a classifier output (co), adjusting at least some parameters of the transfer function in accordance with the classifier output (co), monitoring a user feedback (uf) that is received by the hearing device, and updating the weight vector (w) and/or one of the at least two classifying experts (E1, . . . , Ek) in accordance with the user feedback (uf).

14 Claims, 4 Drawing Sheets

FOREIGN PATENT DOCUMENTS

| | | | |
|---|---|---|---|
| EP | 1523219 | A2 | 4/2005 |
| EP | 1670285 | A2 | 6/2006 |
| EP | 1708543 | A1 | 10/2006 |
| WO | 96/13828 | A1 | 5/1996 |
| WO | 01/76321 | A1 | 10/2001 |
| WO | 03/098970 | A1 | 11/2003 |
| WO | 2004/056154 | A2 | 7/2004 |
| WO | 2008/028484 | A1 | 3/2008 |

OTHER PUBLICATIONS

Written Opinion for PCT/EP2008/053666 dated Jan. 27, 2009.

Kolter, et al. "Dynamic Weighted Majority: A New Ensemble Method for Tracking Concept Drift," Data Mining, 2003. ICDM 2003. Third IEEE International Conference on Nov. 19-22, 2003, Piscataway, NJ, USA, pp. 123-130.

* cited by examiner

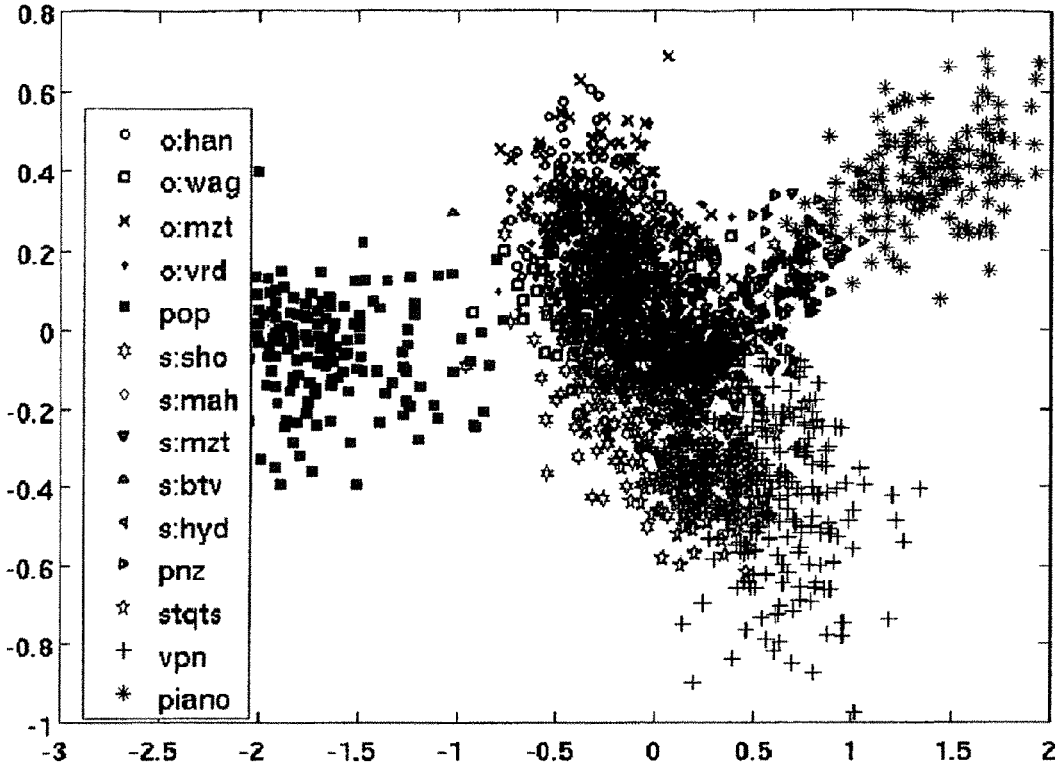
FIG.3
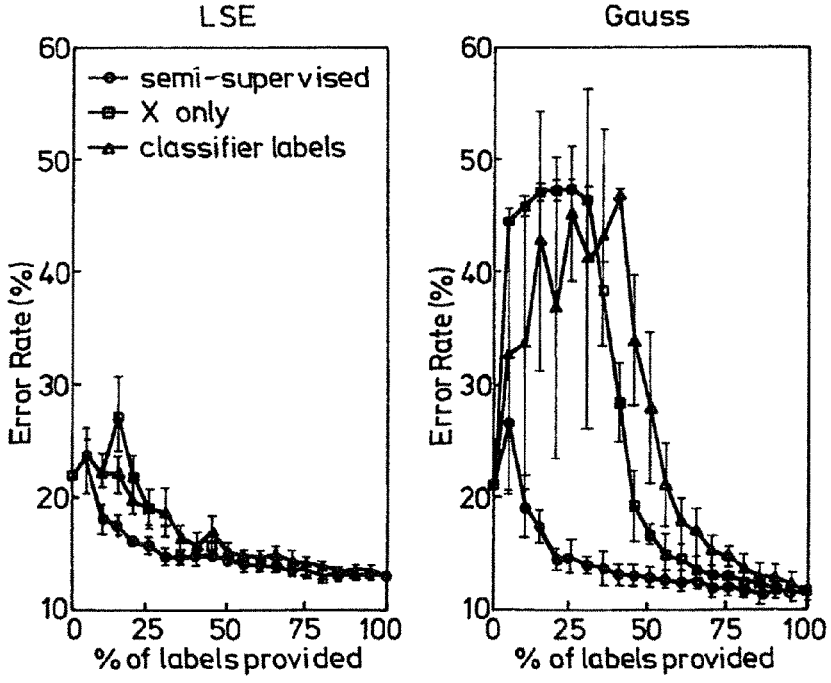

METHOD FOR OPERATING A HEARING DEVICE

The present invention is related to a method for operating a hearing device, in particular an adaptive classification algorithm for a hearing device.

State-of-the-art hearing devices are equipped with an acoustic situation classification system, which subdivides the momentary acoustic situation into classes, such as "speech", "speech in noise", "noise" or "music". It has been proposed to train the classifier with pre-recorded data while adjusting the hearing device for the first time. Usually, the adjustment is done by the manufacturer using a limited amount of training data.

As a consequence thereof, known hearing devices comprising a classifier are delivered with the same settings for the classifiers. Even though a number of different factory settings are available, the potential hearing device users are usually compromised by non-optimal factory settings. In any event, optimal individual settings are not available because no individualization takes place.

Regarding known hearing devices, it is referred to the following documents: WO 2004/056 154 A2, EP-1 670 285 A2, EP-1 708 543 A1 and WO 2003/098 970.

The known hearing devices have a limited learning behavior and suffer from a long reaction time to changing acoustic situations. Furthermore, the known hearing devices cannot deal with unknown acoustic situations, in particular in cases were the new acoustic situation differs largely compared to one of the fixed learned situations. As a result, the known hearing device is actually not able to deal with completely new acoustic situations.

It is therefore one objective of the present invention to overcome at least one of the above-mentioned disadvantages.

This objective is obtained by the features given in claim 1. Advantageous embodiments of the present invention are given in further claims.

The present invention is directed to a method for operating a hearing device. The hearing device comprises an input transducer, an output transducer and a signal processing unit for processing an output signal of the input transducer to obtain an input signal for the output transducer by applying a transfer function to the output signal of the input transducer. The method according to the present invention comprises the steps of:

- extracting features of the output signal of the input transducer,
- classifying the extracted features by at least two classifying experts,
- weighting the outputs of the at least two classifying experts by a weight vector in order to obtain a classifier output,
- adjusting at least some parameters of the transfer function in accordance with the classifier output,
- monitoring a user feedback that is received by the hearing device, and
- updating the weight vector and/or at least one of the at least two classifying experts in accordance with the user feedback.

It is pointed out that the weight vector can be updated in such a manner that one classifying experts, for example, has no contribution to the overall system, i.e. the corresponding element of the weight vector is equal to zero.

An embodiment of the present invention is characterized by further comprising the step of labeling the classifier output in accordance with the user feedback, if such user feedback exists.

Further embodiments of the present invention are characterized by further comprising the step of deriving an estimated user feedback for classifier outputs, for which no user feedback exist.

Still further embodiments of the present invention are characterized by further comprising the step of creating a new classifying expert on the basis of the estimated user feedback.

Other embodiments of the present invention are characterized by further comprising the step of creating a new classifying expert on the basis of the user feedback.

Other embodiments of the present invention are characterized by further comprising the step of evicting an existing classifying expert on the basis of the estimated user feedback.

Other embodiments of the present invention are characterized by further comprising the step of evicting an existing classifying expert on the basis of the user feedback.

Other embodiments of the present invention are characterized by further comprising the step of limiting the number of classifying experts to a predefined value.

Other embodiments of the present invention are characterized in that the step of classifying the extracted features is performed during a predefined moving time window.

Other embodiments of the present invention are characterized by further comprising the steps of:

- computing similarities between feature vectors,
- building a at least partially connected graph of the feature vectors,
- assigning the user feedback as labels to the corresponding feature vector in the graph, and
- propagating user feedback labels to feature vectors, for which no user feedback is present.

Other embodiments of the present invention are characterized by further comprising the steps of:

- computing similarities between feature vectors,
- building at least one partially connected graph of the feature vectors,
- assigning user feedback as labels to the corresponding feature vectors in the graph,
- assigning classifier outputs to the corresponding feature vectors in the graph, and
- propagating the user feedback labels to feature vectors, for which no user feedback is present.

Finally, the present invention is directed to a use of the method according to the present invention during regular operation of a hearing device.

The present invention has the following advantages:

- Learning of whole hearing device setting, not only one processing parameter (e.g. volume).
- No discrete learning/automatic modes; learning happens whenever there is a discrepancy between automatic classification and user feedback.
- It is possible to learn concept drifts unsupervised (i.e. without user feedback).
- It is possible to learn based on unilateral user feedback only (i.e. user gives feedback only if he is dissatisfied).
- Learning of binary decisions, e.g. like/dislike within the music class, as well as multi-class decisions.
- Learning of new concepts, e.g. a new music style or an unseen noise type.
- Immediate response to a user feedback.
- Stable operation (i.e. the classification cannot (deliberately or not) screwed up).

The present invention is relevant for any hearing device product to ease the troublesome and iterative fitting process. Therefore, the costs for the fitting can be reduced substantially. In addition, the present invention allows an advanced self-fitting for hearing devices.

The present invention will be further described by referring to drawings showing exemplified embodiments of the present invention.

Figure 2:
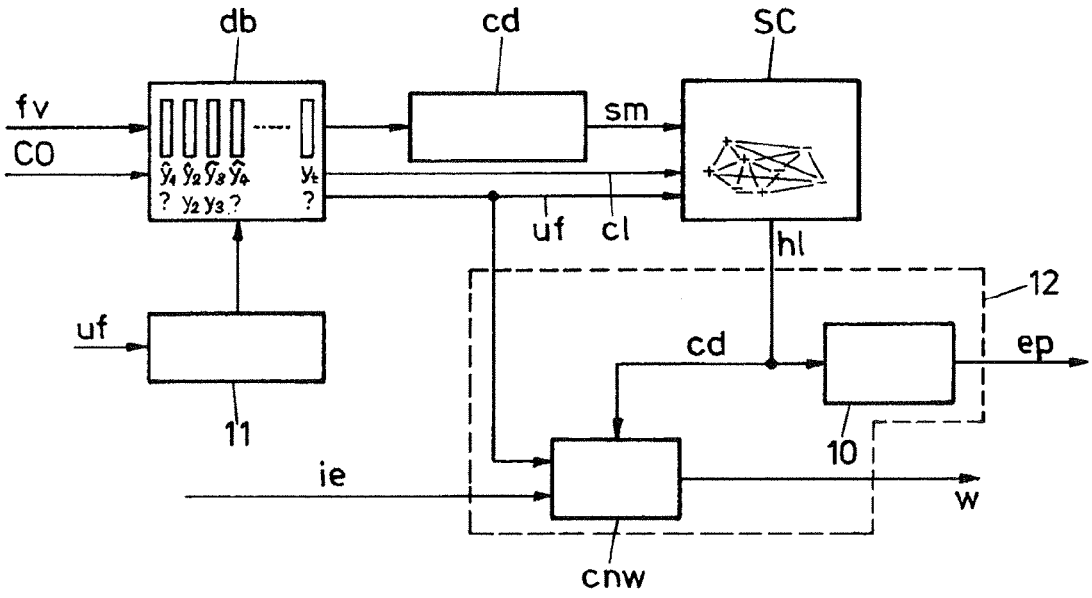
Figure 4:
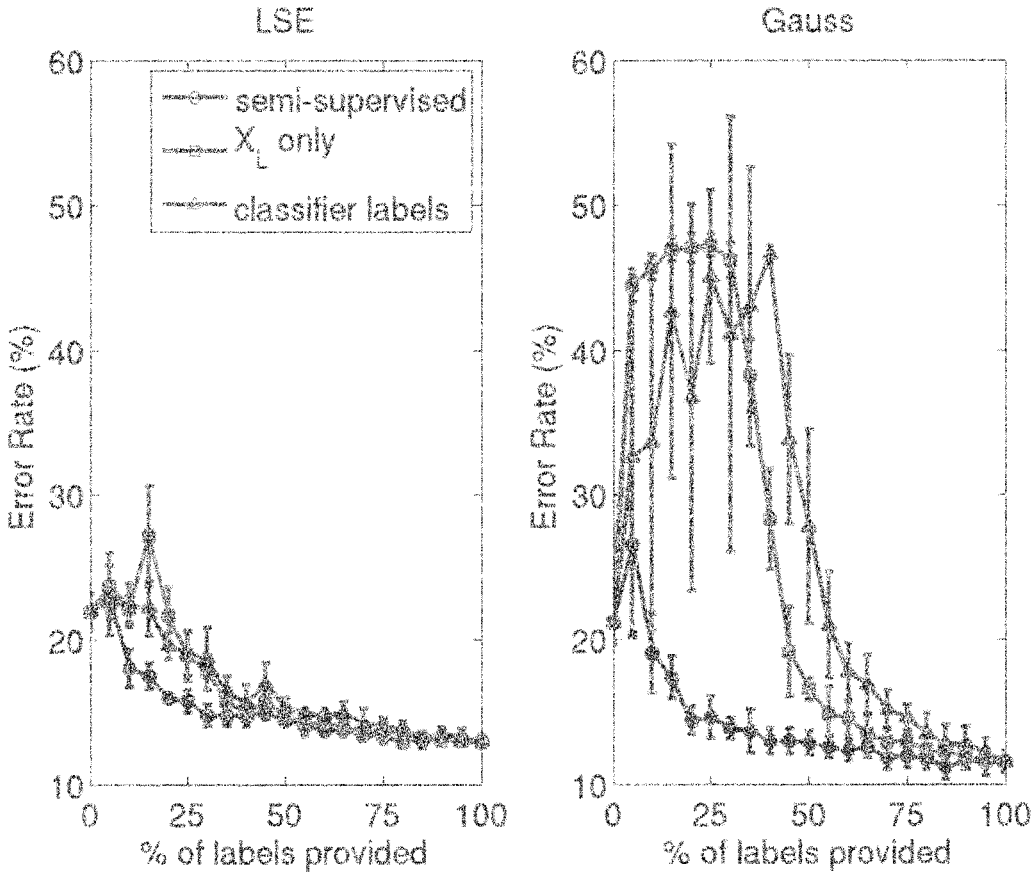
Figure 5:
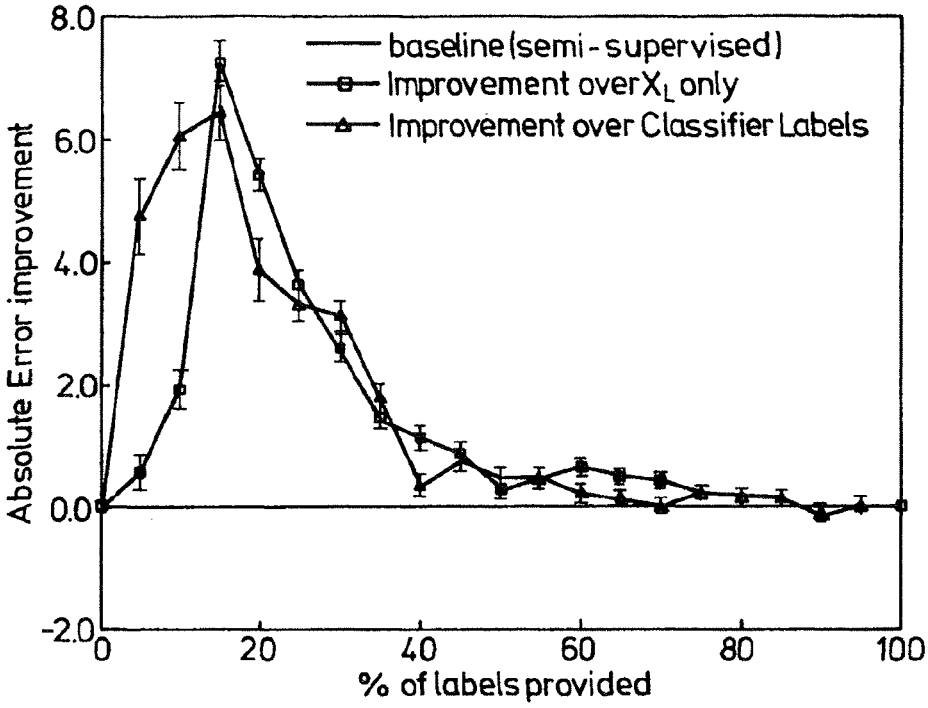
Figure 6:
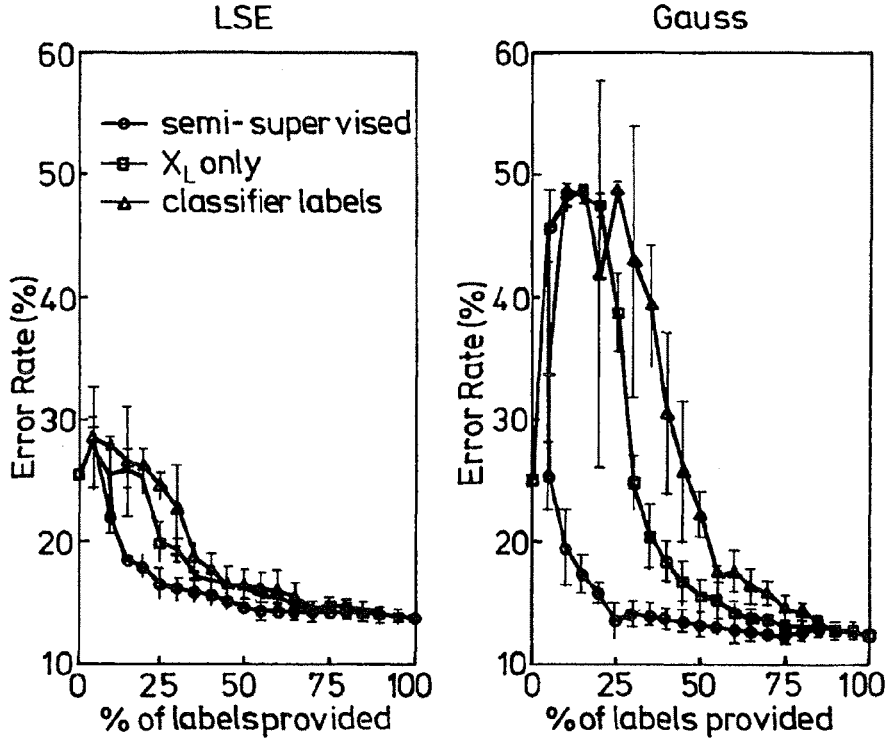

FIG. 1 shows a block diagram of a hearing device with a classifier according to the present invention, FIG. 2 shows a further block diagram to illustrate the algorithm of the present invention, FIG. 3 is a visualization of data onto two-dimensional space using Fisher LDA, FIG. 4 shows cumulative errors on learning concept changes versus ratio (percentage) of available labels for LSE (left graph) and Gaussian (right graph) classifying experts, FIG. 5 shows absolute error improvement of a semi-supervised system over comparison strategies (100 random runs), and FIG. 6 shows cumulative error on learning new concepts, again for a LSE (left graph) and a Gaussian (right graph) classifying expert.

FIG. 1 shows a block diagram of a hearing device comprising, in a main signal path, an input transducer 1, e.g. a microphone, to convert an acoustic signal to a corresponding electrical signal, a signal processing unit 2 to process the electrical signal, and an output transducer 3, e.g. a loudspeaker, also called a receiver in the technical field of hearing devices, to convert an electrical output signal of the signal processing unit 2 to an acoustic output signal that is fed into the ear canal of a hearing device user. Furthermore, the hearing device comprises an extraction unit 4, a classifier unit 5, a fading unit 9, a learning unit 7 and an input unit 8 that is operationally connected to a remote unit (not shown in FIG. 1) for transmitting a user input of the hearing device user.

The output signal of the input transducer 1 is operationally connected to the signal processing unit 2 as well as to the extraction unit 4 that is operationally connected to the classifier unit 5 and to the learning unit 7, also via the classifier unit 5, for example, as it is depicted in FIG. 1 inside the block for the classifier unit 5. The learning unit 7 is operationally connected to the input unit 8 via a bidirectional connection as well as to the fading unit 9, to which also the classifier unit is operationally connected. Finally, the fading unit 9 is connected to the signal processing unit 2.

The arrangement of the extraction unit 4 and the classifier unit 5 is generally known for estimating a momentary acoustic situation in order to select a hearing program that best fits the detected acoustic situation. Reference is made to U.S. Pat. No. 6,895,098 or to U.S. Pat. No. 6,910,013, which are herewith incorporated by reference.

According to the present invention, the classifier unit 5 comprises several classifying experts E1 to Ek—i.e. at least two classifying experts E1 and E2—and a mixing unit 6 to combine the outputs of the classifying experts E1 to Ek. Every classifying expert E1 to Ek is a small classifier (e.g. a linear classifier or a Gaussian mixture model). The output of the classifier unit 5, hereinafter called classifier output CO, is a weighted combination of the individual outputs of the classifying experts E1 to Ek. The weights for the combination of the outputs of the classifying experts E1 to Ek are generated in the learning unit 7 on the basis of information obtained via the input unit 8, the features detected by the extraction unit 4 and the classifier output CO. The output of the learning unit 7 is hereinafter called weight vector w and is associated with the experts E1 to Ek. The input unit 8 collects a user feedback, for example, via a remote control or a speech recognizer. The remote control can be as simple as a device having a "dissatisfied"-button only, or it may contain multiple feedback controls, for example for specific preferred listening programs. These user feedback serves to label the current acoustic scene. The speech recognition controller comprises an algorithm for automatically detecting key words that are transformed into specific labels associated with the current setting.

In a further embodiment of the present invention, the input unit 8 is operationally connected to a gesture recognizer comprising an algorithm for automatically detecting gestures that are transformed into specific labels being attached to the particular setting.

In a further embodiment of the present invention, the input unit 8 is operationally connected to a video recognizer comprising an algorithm for automatically detecting a user behavior (a head or a body movement, for example) that is transformed into specific labels being attached to the particular setting.

The classifier output CO is fed to the signal processing unit 2 via the fading unit 9 in order to adjust the processing of the output signal of the input transducer 1. In fact, a transfer function and/or parameters of the transfer function being applied to the output signal of the input transducer 1 is adjusted to better comply to the momentary acoustic situation detected by the extraction unit 4 and the classifier unit 5. Once the adjustment of the transfer function is completed, the hearing device user may give a user feedback via the input unit 8 to label the new adjustment, i.e. the extracted features and the classifier output CO.

While in one embodiment, the fading unit 9 directly transfers the classifier output CO to the signal processing unit 2, a smooth transition is implemented in another embodiment of the present invention. For example, it is proposed to have a smooth transition for any automatic adjustments, while a clear and abrupt transition to a new setting is performed in cases where the user request for a change by generating a corresponding user feedback. Such an implementation bears the advantage that a request by the user is perceivable by the user himself, which actually is a confirmation that a certain action has been triggered in the hearing device, while a sudden automatic switching of the settings being applied to the output signal of the input transducer 1 would discomfort the hearing device user because an unexpected switching is generally easy to perceive acoustically, and therefore is unwanted.

FIG. 2 shows a block diagram for illustrating an algorithm that is implemented in the learning unit 7 (FIG. 1).

Feature vectors fv generated by the extraction unit 4 (FIG. 1) and contained in a certain time window are stored in a database db together with the classifier output co and the user feedback uf. The user feedback uf results from the input unit 8 as explained in connection with FIG. 1. In a block cd, affinities/similarities are computed between all feature vectors fv of the database db, and a similarity matrix sm is generated.

In one embodiment of the present invention, a time stamp is also stored for every feature vector fv. As a result thereof, consecutive feature vectors fv can easily be identified and normally tend to have a higher affinity/similarity.

Based on the computed affinities/similarities contained in the similarity matrix sm, a graph (i.e. in the mathematical sense) is constructed that represents all feature vectors fv with corresponding similarities. Each node in the graph is assigned a label, which depends on the classifier output co for this feature vector fv and the user feedback uf. Due to the fact that the hearing device user does not generate a user feedback uf for every feature vector fv, some of the feature vectors fv are unlabeled.

In a block sc, the graph is generated from the similarity matrix sm. Due to the above-mentioned fact that not all feature vectors fv are labeled, the algorithm is said to be of the type "semi-supervised learning".

When the graph is constructed and initialized, a message passing algorithm infers a label for every node. The new assignment of labels to feature vectors fv is used to adjust the mixture-of-experts classifier and is also called propagation algorithm meaning that a label is generated for those feature vectors that have not been labeled by the hearing device user via user feedback uf. Label propagation will be further described in the following.

In a block identified by 12, a decision is reached based on the results of the label propagation algorithm: The weight vector w is adapted in order to take into account of this so-called "concept drift", i.e. those classifying experts E1 to Ek that obtained a erronous result are assigned a lower weight. The new weight vector w is then applied to the individual outputs ie of classifying expert E1 to Ek from now on to generate the classifier output co as explained in connection with FIG. 1. In case that a node of the graph differs to a larger extend than a preset value, it is assumed that a completely new acoustic situation has been observed, which must be taken into account in the future. Therefore, a new classifying expert is generated to fulfill a more accurate classification.

In a further embodiment of the present invention, each time a new classifying expert is created an existing classifying expert E1 to Ek is evicted.

The user feedback uf is processed before it is fed to the database db in a block identified by the reference sign 11. The processing of the user feedback uf may have the effect:

- that the corresponding user feedback uf immediately is effective (instantaneously);
- that a large user feedback uf results in a new classifying expert E1 to Ek;
- that a user feedback uf only takes place if it falls within a preset time window.

It is emphasized that the concept of the algorithm according to the present invention has been described. Detailed computations may differ entirely. For instance, the classifying experts E1 to Ek may comprise different (prior-art) classification algorithms. Furthermore, the type of similarity measure between feature vectors fv may differ, or the graph-based classification may be replaced by any semi-supervised classification algorithm known in the art.

The present invention is envisaged to be flexible enough to deal with different kind of user feedback uf. The concrete form of user feedback may be in the form of a "dissatisfied"-button, a choice out of different classes (i.e. hearing programs), etc. The user feedback uf may be given by manipulating buttons, switches, etc., a remote device, using a speech recognizer, using a gesture recognizer or others.

It is noted that the complexity of the proposed algorithm is quite high. Therefore, it is proposed to implement the computations not in the hearing device itself. For example, the remote control can have a powerful enough processing unit, or an additional wired or wireless device, such as a mobile phone, a PDA-(Personal Digital Assistant), etc. can take over the necessary computations.

As an example, the classification of music (G. Tzanetakis and P. Cook, "Musical genre classification of audio signals", IEEE Trans. on Speech and Audio Processing, vol. 10, no. 5, 2002) is considered. Algorithms should satisfy a number of requirements:

1. Online adaptation: The classifier may come with a factory setting, but has to adapt to the preferences of an individual user, preference changes and new types of music.
2. Sparse feedback: A user cannot be expected to provide a constant stream of labels.
3. Passivity: The user can provide feedback to express discontent with current performance. Hence, unless at least some feedback is received, the classifier should remain unchanged.
4. Efficiency: Feature extraction, training and data classification have to be performed online by a portable device.

To address the adaptation and online problems, a classification algorithm is proposed based on additive expert ensembles (J. Z. Zolter and M. A. Maloof, "Using additive expert ensembles to cope with concept drift.", in Proceedings of the 22nd Intl Conference on Machine Learning, 2005.). Predictions of a fixed number of classifiers are combined by weighted majority. The weights are updated at each iteration such that well performing classifiers make large contributions. To cope with the sparse feedback problem, it is shown how the online learning algorithm can be combined with a label propagation algorithm for semi-supervised learning (O. Chapelle, B. Schölkopf, and A. Zien, Eds., *Semi-Supervised Learning*, MIT Press, Cambridge, Mass., 2006). Music data are well-suited for semi-supervised methods, which attempt to improve classification performance by incorporating unlabeled data into the training process. The data distribution has to fulfill regularity assumptions for a successful transfer of label information from labeled to unlabeled points which holds for music data with similar types of instrumentation.

Training a classifier to separate preferred from non-preferred classes results in a preference structure that can easily take into account new subclasses/genres without wasting capacity to identify each genre specifically, and hence is more appropriate than the common genre classifications. Experimental results show that the proposed classifier meets the requirements: It can adjust to both new music and changes in preference. Moreover, incorporating unlabeled data by label propagation significantly improves prediction performance when labels are sparse.

Online learning: Most supervised learning algorithm operate under a batch assumption: A complete, static set of training data is assumed to be available prior to prediction. Additionally, at least for theoretical analysis, training data is assumed to be i.i.d., conditional on the class. Online learning (N. Cesa-Bianchi and G. Lugosi, Prediction, learning and games, Cambridge University Press, 2006.) generalizes this scenario by assuming data points to be available one at a time, with each observation serving first as test, and then as training point. For a new data value, a prediction is made. After prediction, a label is obtained, and the observation is included in the training set. These methods only assume that the complete data sequence is generated by the same instance of the generative process—if the process is restarted, the classifier has to be trained anew. The data is not required to be i.i.d. On the theoretical side, well-known concentration-of-measure bounds of standard supervised learning are replaced by guarantees on the algorithm's performance relative to an optimal adversary, operating under identical conditions. In an i.i.d. batch scenario, online learning algorithms are expected to perform worse than a well-chosen batch learner, but they are capable of dealing with both incrementally available data and data distributions that change over time.

Semi-supervised learning: In semi-supervised learning (O. Chapelle, B. Schölkopf, and A. Zien, Eds., Semi-Supervised Learning, MIT Press, Cambridge, Mass., 2006), the system is presented with both labeled data, denoted XL, and unlabeled data XU. The unlabeled data can provide valuable information for the training process. The risk (expected error) of a classifier in a given region of feature space is proportional to the local data density (under the commonly used, spatially uniform loss functions). To achieve low overall risk, a classifier should be most accurate in regions with high data density. Class density estimates obtained from unlabeled data can be used to inform training algorithms on where to focus. Unlabeled data is commonly exploited in either of two ways: Directly, e.g. by nonparametric density estimates used for risk estimation, or indirectly, by transferring labels from labeled to unlabeled data. Both approaches are based on the notion that points sufficiently "close" to each other are likely to belong to the same class, which implies regularity assumptions on the class distributions: One is that the individual class densities are sufficiently smooth. The other is that classes are well-separated, that is, the density in overlap regions is small (and hence has small risk contribution). If these are not satisfied, unlabeled data should be used with care, as it may be detrimental to system performance.

The learning problem described in the introduction is formalized as follows: We start with a baseline classifier (factory setting). New data values $x_t$ (sound features) are provided sequentially. Some of these observations are labeled by the user as $$y_t \in \{-1,+1\}.$$

In this example, only two classes are present. It is clear to the skilled in the art that the present invention is very well suitable for a larger number of classes. In fact, an arbitrary number of classes can be used.

The feedback label $y_t$ is assumed to be available between observations $x_t$ and $x_{t+1}$. If no feedback is provided, then $y_t=0$. Changes in the input data distribution may occur, representing two cases:

New concept: Data with a distribution not previously used in training is introduced.

Concept change: Labels are contradictory to previous ones.

The online aspect of the learning problem is addressed by means of an additive expert ensemble (J. Z. Zolter and M. A. Maloof, "Using additive expert ensembles to cope with concept drift" in Proceedings of the 22nd Intl Conference on Machine Learning, 2005). The overall classifier is an ensemble of up to $K_{max}$ weighted experts (component classifiers), denoted $\eta_{t,k}$ for time step t and component k. The experts are combined as a linear combination with non-negative weights. Given a new, labeled observation $(x_{t+1}, y_{t+1})$, the algorithm adjusts the classifier weights according to current error rates of the experts. Components performing well on the current data set receive large weights. Additionally, new experts are introduced, and poor performing experts are discarded to bound the total number $K_t$ of components by $K_{max}$. As the application scenario requires a bounded memory footprint, previously observed data cannot be stored indefinitely. We therefore window the learning algorithm, that is, updates in each round performed on moving window of constant size. Knowledge obtained from observations in previous rounds is stored only implicitly in the state of the classifier, until new, contradictory information votes against it.

Standard online learning algorithms adapt the classifier after each sample. We assume that feedback is provided only to change the state of the classifier. While the system is performing to the user's satisfaction, no feedback should be required. The learning algorithm therefore incorporates a passive update scheme: If no feedback is received, the classifier remains unchanged. The learning algorithm only acts if the current data point $x_t$ is labeled by the user. In this case, observations in the current window up to $x_t$ are used to change the classifier.

To integrate unlabeled data into the learning process, the online learning algorithm is combined with a semi-supervised approach. The method we employ is a graph-based approach for label transfer, a choice motivated in particular by the window-based online method. Since the window size limits the amount of data available at once, direct density estimation is not applicable. Graph-based methods are known for good performance on reasonably regular data. Their principal drawback, quadratic scaling with the number of observations, is eliminated by the constant window size. The particular method used here is known as label propagation (D. Zhou, O. Bousquet, T. N. Lal, J. Weston, and B. Schölkopf, "Learning with local and global consistency" in Advances in Neural Information Processing Systems. MIT Press, 2004, vol. 16, pp. 321-328). Data points are regarded as nodes of a fully connected graph. Edges are weighted by pairwise similarity weights for data points (such as exponential of the negative Euclidean distance). In large-sample scenarios, the computational burden for fully connected graphs is often prohibitive, but in combination with the (windowed) online algorithm, the graph size is bounded. Label propagation spreads label information from labeled to unlabeled points by a discrete diffusion process along the graph edges. The diffusion operator in Euclidean space is discretized according to the graph's notion of affinity by the normalized graph Laplacian L. The latter is computed from the graph's affinity matrix W and diagonal degree matrix D. The entries of W are pairwise affinities, and D is computed as $$D_{ii} := \Sigma W_{ij}.$$

The normalized graph Laplacian is then defined as $$L := D^{-\frac{1}{2}} \cdot W \cdot D^{-\frac{1}{2}}.$$

For each sample $x_t$, the algorithm executes a prediction step, then possibly obtains a label either as user feedback or by label propagation, and finally executes a learning step. It takes three scalar input parameters: A trade-off parameter $$\alpha \in [0,1]$$

controls how rapidly label information is transferred along the edges during the propagation step. For the learning step, $$\beta \in [0,1] \text{ and } \gamma \in \Re_{-}$$

control the decrease of expert weights and the coefficients of new experts, respectively. The prediction step for $x_t$ is 1. Get expert predictions $\eta_{t,1}, \ldots, \eta_{t,N_t} \in \{-1,+1\}$,
2. Output prediction:

$$\hat{y}_t = \operatorname{argmax}_{c \in Y} \sum_{i=1}^{N_t} w_{t,i}[c = \eta_{t,i}]$$

The learning step is executed if $y_t$ is not 0. The algorithm first propagates labels to unlabeled points, and then updates the classifier ensemble.

The graph Laplacian $L_t$ has to be updated for the current window index t.

1. Propagation:
   a) Initialize estimate vector as $\hat{Y}_t^{(0)} = Y_t$
   b) Iterate $\hat{Y}_t^{j+1} = \alpha L_t \hat{Y}_t^{(j)} + (1-\alpha)\hat{Y}_t^{(0)}$
   c) Assign each $x_i$ the label given by $\operatorname{sign}(\hat{y}_i^{final})$ 2. Learning:

a) Update expert weights: $w_{t+1,i}=w_{t,i}\beta^{[y_t \neq y_{t,i}]}$ b) If $\hat{y} \neq y_t$ then add a new expert: $N_{t+1}=N_t+1$ $$w_{t+1,N_{t+1}} = \gamma \sum_{i=1}^{N_t} w_{t,i}$$

c) Update each expert on example $x_t, y_t$

Due to the limited window size, the label propagation is efficient and runs until equilibration. The first step interpolates the label of each unlabeled point from all other nodes. Due to similarity-weighted edges, only points close in feature space have a significant effect. Further steps correspond to longer-range correlations, i.e. affecting nodes over paths of length 2, 3 etc. Allowing the graph to equilibrate therefore improves the quality of results for uneven distribution of labels in feature space. Once the propagation step terminates, class assignments for the unlabeled input points are determined by the polarity of their accumulated mass. The resulting hypothesized labels are presented to the classifier ensemble as "true" labels.

Experiments: For evaluation, we built a music database of 2000 files. The bulk of the database is "classical music": opera (Händel, Mozart, Verdi and Wagner), orchestral music (Beethoven, Haydn, Mahler, Mozart, Shostakovitch) and chamber music (piano, violin sonatas, and string quartets). A small set of pop music was also included to serve as "dissimilar" music.

Features are computed from 20480 Hz mono channel raw sources. We compute means of 12 MFCC components (Daniel P. W. Ellis, "PLP and RASTA (and MFCC, and inversion) in Matlab," 2005, online web resource) and their first derivatives, as well as means and variances of zero crossing, spectral center of gravity, spectral roll-off, and spectral flux.

In total we obtain a 32-dimensional feature vector per file. FIG. 3 shows a two-dimensional Fisher linear discriminant analysis (LDA) projection of features averaged over each song or track (i.e. one point per track in the plot). Since the current study focuses on the classification algorithm, we do not consider higher-level features (G. Tzanetakis and P. Cook, "Marsyas: A framework for audio analysis," 2000).

Results reported here use signatures of complete songs. A real world application would, of course, have to use partial signatures, such that the system can react to new music without long delays. Reference experiments with a static classifier show that between 20 and 60 seconds of music are required to obtain a reliable classification for the current features.

Classifier Settings: The additive expert is based on an ensemble of simple component classifiers. Two types components were used in the experiments: A least mean-squared error (LSE) classifier, and a full covariance Gaussian model (GM). The decision surfaces of the individual components are hyperplanes in the LSE case, and quadratic hypersurfaces for the GM. (Using a Gaussian mixture instead of an individual Gaussian for each class proved not to be useful in preliminary experiments.) The two principal differences between the two classifiers are the fact that the GM constitutes a generative model, whereas the LSE model does not, and that the GM is more powerful. The set of hyperplanes expressible in terms of LSE is included in the GM as a special case. Higher expressive power comes at the price of higher model complexity. In d-dimensional space, the GM estimates $$2 \cdot \left(d + \frac{d \cdot (d+1)}{2}\right)$$

parameters, compared to d+1 for the LSE.

A baseline model is first learned on an initial set of data. During the evaluation phase, the remaining data is presented to the classifier sequentially. When no labels are provided, the classifier does not update, such that values reported for 0% shows the performance of a static baseline classifier. When all labels are provided, we obtain the conventional, fully supervised online learning scenario. For both choices of experts, we compare the semi-supervised online algorithm to two other learning strategies. The three variants shown in each of the diagrams are:

1. $X_U$ takes the label hypothesized by the label propagation (semi-supervised).
2. $X_U$ is ignored and not used for learning ($X_L$ only).
3. $X_U$ takes the label hypothesized by the current classifier (classifier labels).

Results are reported in terms of cumulative error on the evaluation data. That is, if $\hat{y}_t$ denotes the label predicted by the classifier for $x_t$, the error is measured as $$Err = \frac{1}{T} \cdot \sum_{t=1}^{T} [\hat{y}_t \neq y_t]$$

Experimental Results: Results are presented separately for two mismatch scenarios: change of concepts (i.e. of user preferences), and appearance of new concepts. The experiments simulate behavior in adaptation phases. During normal operation, the user need not provide any labels. Since the classifier is passive, user action is required only in order to prompt the system to adapt.

Learning a changed concept: The baseline model is trained on 2 sets consisting of sub-clusters {o:*, pop} and {s:*, strqts, pno}. During the evaluation phase, sub-clusters s:mah, s:sho and pop are reassigned to the opposite classes. FIG. 4 shows the results for both GM and LSE models. When the proportion of label data is low, using the unseen labels via label propagation significantly improves system performance. In all experiments conducted, the semi-supervised algorithm consistently outperforms the other approaches until at least about 80% of labels are available. The error rate at 0% is the performance of the initial baseline system. Initially, for very small numbers of labels, over fitting to the labeled subset decreases prediction accuracy with respect to the baseline. Interestingly, for small label ratios, over fitting effects increase with the number of labels, until the error peaks and then decreases. More labeled points mean more adjustment steps, and therefore stronger over fitting if the available information is insufficient. Hence, the peaks in error rates are due a trade-off effect between the information provided by the labels and the number of learning steps they trigger. The decrease in performance is most notable for Gaussian experts, which are less robust than the LSE experts. In a real-world implementation, one would choose the baseline classifier until a minimum ratio of labels is available. While the semi-supervised approach requires about 10% of labels to start improving upon the baseline method, between 20% (LSE) and 40% (Gaussian) are required if the unlabeled data is neglected. At large label ratios, the Gaussian model slightly outperforms the LSE. The semi-supervised version of the model requires only about 40% of labels to reach optimal performance.

To evaluate the average behavior of the system when the change of concept is not hand-picked, we generated 100 random runs of groupings of the sub-clusters. For each case, four sub-clusters reverse their labels during evaluation phase. FIG. 5 plots the absolute improvement in error rates of the semi-supervised method over the two comparison classifiers, showing behavior consistent with the results in FIG. 4.

Learning a new concept: The second type of classifier adaptation is adjustment to previously unobserved music. Of particular interest is the classifiers behavior when the new concept substantially differs from those already incorporated in the baseline model. In this experiment, the baseline model is trained on opera, {o:*}, and classical orchestral/chamber music. During the evaluation phase, "modern" music (Mahler and piano) are assigned to the opera class, and pop music and Shostakovitch to the other class. FIG. 6 shows the results for the LSE classifier. As in the concept change case, the amount of feedback required by online learning with label propagation is substantially reduced with respect to the fully supervised method.

An algorithm for music preference learning has been presented that combines an online approach to learning with a partial label scenario. The classifier is capable of tracking changes in class distributions and adapting to data that differs from previous observations, in reaction to user feedback. Due to the integration of unlabeled data in the learning process, only partial feedback is required for the classifier to achieve satisfactory performance. The algorithm remains passive unless user feedback triggers an adaptation step. A window-based design limits both computational costs and memory requirements in an economically feasible range.

A step towards applicability in a real-world scenario will require incorporating strategies that enable the algorithm to classify a new piece of music as early as possible. Acoustic features should be chosen accordingly. Adaptation speed has to be traded of against reliability, to prevent the device from oscillating back and forth due to initially unreliable estimates. Since different types of music are more or less quickly recognizable, one may consider estimating reliability scores for classification results to control changes in the current control program of the system.

Our algorithm design does not make any assumptions about the base learner. In principle, any classification algorithm may be used, e.g., the proposed algorithm may be extended by kernelization of the LSE base learner, which generalizes decision boundaries beyond the linear case. We expect our method to be a step towards adaptivity in the control of "smart" hearing devices.

The invention claimed is:

1. A method for operating a hearing device comprising an input transducer (1), an output transducer (3) and a signal processing unit (2) for processing an output signal of the input transducer (1) to obtain an input signal for the output transducer (3) by applying a transfer function to the output signal of the input transducer (1), the method comprising the steps of:

extracting features of the output signal of the input transducer (1), classifying the extracted features by at least two classifying experts (E1, . . . , Ek), weighting outputs of the at least two classifying experts by a weight vector (w) in order to obtain a classifier output (co), adjusting at least some parameters of the transfer function in accordance with the classifier output (co), monitoring a user feedback (uf) that is received by the hearing device, and updating the weight vector (w) and/or at least one of the at least two classifying experts (E1, . . . , Ek) in accordance with the user feedback (uf).

2. The method according to claim 1, characterized by further comprising the step of labeling the classifier output (co) in accordance with the user feedback (uf), if such user feedback (uf) exists.

3. The method according to claim 1 or 2, characterized by further comprising the step of deriving an estimated user feedback for classifier outputs (co), when no user feedback (uf) is received.

4. The method according to claim 3, characterized by further comprising the step of creating a new classifying expert (E1, . . . , Ek) on the basis of the estimated user feedback (uf).

5. The method according to claim 4, characterized by further comprising the step of evicting an existing classifying expert (E1, . . . , Ek) on the basis of the estimated user feedback (uf).

6. The method according to claim 3, characterized by further comprising the step of evicting an existing classifying expert (E1, . . . , Ek) on the basis of the estimated user feedback (uf).

7. The method according to claim 1 or 2, characterized by further comprising the step of creating a new classifying expert (E1, . . . , Ek) on the basis of the user feedback (uf).

8. The method according to claim 7, characterized by further comprising the step of evicting an existing classifying expert (E1, . . . , Ek) on the basis of the user feedback (uf).

9. The method according to claim 1, characterized by further comprising the step of evicting an existing classifying expert (E1, . . . , Ek) on the basis of the user feedback (uf).

10. The method according to claim 1, characterized by further comprising the step of limiting the number of classifying experts (E1, . . . , Ek) to a predefined value.

11. The method according to claim 1, characterized in that the step of classifying the extracted features is performed during a predefined moving time window.

12. The method according to claim 11, characterized by further comprising the steps of:

generating feature vectors (fv) from the extracted features, computing similarities between the feature vectors (fv), building at least one partially connected graph of the feature vectors (fv), assigning the user feedback (uf) as labels to the corresponding feature vector (fv) in the graph, and propagating the user feedback labels to feature vectors (fv), for which no user feedback (uf) is present.

13. The method according to claim 11, characterized by further comprising the steps of:

generating feature vectors (fv) from the extracted features, computing similarities between the feature vectors (fv), building at least one partially connected graph of the feature vectors (fv), assigning the user feedback (uf) as labels to the corresponding feature vectors (fv) in the graph, assigning the classifier outputs (co) to the corresponding feature vectors (fv) in the graph, and propagating the user feedback labels to feature vectors (fv), for which no user feedback (uf) is present.

14. Use of the method according to claim 1 during regular operation of the hearing device.

* * * * *